United States Patent [19]

Huber et al.

[11] 4,225,267

[45] Sep. 30, 1980

[54] HIGHWAY EXPANSION JOINT ASSEMBLY

[75] Inventors: Reinhold Huber, Rorbas, Switzerland; Waldemar Köster, Forsbach, Fed. Rep. of Germany

[73] Assignee: Kober AG, Switzerland

[21] Appl. No.: 25,270

[22] Filed: Mar. 29, 1979

[30] Foreign Application Priority Data

Sep. 28, 1978 [DE] Fed. Rep. of Germany ..... 2842228

[51] Int. Cl.[3] ..... E01C 11/04

[52] U.S. Cl. ..... 404/69; 52/396; 14/16.5

[58] Field of Search ..... 404/68, 69, 74, 47; 52/396, 403; 14/16.5

[56] References Cited

U.S. PATENT DOCUMENTS

| | | | |
|---|---|---|---|
| 3,363,522 | 1/1968 | Galbreath | 14/16.5 X |
| 3,520,236 | 7/1970 | Sequaris | 14/16.5 |
| 3,717,969 | 2/1973 | Sequaris | 404/68 X |
| 3,880,539 | 4/1975 | Brown | 404/68 X |
| 3,880,540 | 4/1975 | Rizza | 404/69 |
| 3,899,261 | 8/1975 | Mieville | 404/68 |
| 4,007,994 | 2/1977 | Brown | 404/69 |
| 4,080,207 | 9/1977 | Bertschmann | 404/68 X |

FOREIGN PATENT DOCUMENTS

| | | | |
|---|---|---|---|
| 2238012 | 2/1975 | France | 404/69 |
| 565284 | 8/1975 | Switzerland | 404/69 |

*Primary Examiner*—Nile C. Byers, Jr.

[57] ABSTRACT

An elongated elastomeric strip has means along the longitudinal edge for fastening to a receiving element secured in a roadbed. The fastening element comprises at least one set of retaining members, each having a head portion at least in part embedded and bonded securely in the elastomeric strip and a projecting portion depending from the strip. The retaining members are arranged so that the projecting ends of some of them face oppositely to the projecting ends of the others of them, thereby being relatively movable toward and away from each other under deformation of said strip and cooperate to resiliently clamp onto the receiving element. The projecting ends of the retaining members are preferably claw-like.

21 Claims, 9 Drawing Figures

HIGHWAY EXPANSION JOINT ASSEMBLY

BACKGROUND OF THE INVENTION

The present invention relates to vehicular road or highway expansion joints and, in particular, to elastic cover strip assemblies, which seal the gap between abutting road sections and the means for securing the same directly to the base of the roadway.

It has been known from German Pat. No. 2,155,651 and U.S. Pat. No. 3,324,774 to provide an expansion joint assembly comprising an elongated strip having fastening elements vulcanized to the opposite longitudinal edges which elements are capable of being screwed or bolted to connecting sections, anchored in the concrete substructure of a road. Such a construction suffers from the fact that the screw connections are cumbersome to assemble under field conditions, and in addition require an exact alignment in fitting of the hole spacings therein for the accommodation of the screws or bolts. Further, it is practically impossible to obtain a secure seal against water and moisture. Lastly, in order to remove the assembly, it is necessary to destroy the surrounding paving in order to remove the screws.

German Patent disclosure 2,011,822 wedges bent portions of the elastomeric strip into grooves formed along the edge of the abutting roadway sections. While this kind of edge connection facilitates the removal of the strip, such strips are limited with respect to their load carrying capacity. In this connection, it is also known from the German Patent disclosure 1,784,675 to replace the wedges by cables threaded into holes along the edges of the strip which cables are secured within the groove along the substructure edge. This latter construction also has a low load carrying capacity and in addition is difficult to assemble and to disassemble.

The present invention overcomes these disadvantages by providing an expansion joint assembly comprising an elongated elastomeric covered strip which may be easily assembled and disassembled from the connection with the roadway subbase and which has a particularly strong reinforced are capable of withstanding high traffic loads.

SUMMARY OF THE PRESENT INVENTION

According to the present invention, an expansion joint assembly for attachment to vehicular roadbeds and the like comprises an elongated elastomeric strip having means along the longitudinal edge for fastening to a receiving element secured in the roadbed. The fastening element comprises at least one set of retaining members, each having a head portion at least in part embedded and bonded securely in the elastomeric strip and a projecting portion depending from the stip. The retaining members are arranged so that the projecting ends of some of them face oppositely to the projecting ends of the others of them, thereby being relatively moveable toward and away from each other under deformation of said strip and cooperate to resiliently clamp onto the receiving element. Preferably, the projecting ends of the retaining members are provided with claw-like ends and the receiving element is provided with recesses or protrusions formed in a corresponding shape.

The retaining members form the connecting parts between the strip and the roadway and serve in addition to stiffen and to reinforce the edge area along the length of the strip. By means of the clamp action, preferably through the use of claws and hook members, the connecting link with the roadway is strong while being capable of easy assembly and disassembly. Due to the fact that the retaining members are permanently bonded into the mass of the elastomeric material forming the strip, a resilient restorative force is generated by the relative movement toward and away from each other of their projecting ends. This movement causes the ends, preferably formed with the claws or hooks to be retained in the receiving element in a secure manner. When the receiving element is formed with a conforming shaped channel or protrusion, the projecting ends preferably claws and/or hooks will make a permanent fastening.

The elongated strip may be provided with additional reinforcing inserts in the form of hard elastic material and/or steel. These inserts may be in the form of coils, bar plates, or the like, which are movable with the expansion and contraction of the strip. In one form of the invention, helical coils are employed which are secured to the head portion of the retaining member embedded within the strip.

Preferably, the head end of the retaining member is completely embedded within the material of the strip and has a lower straight edge, coincident with the lower surface of the strip so that it forms with the strip a bearing surface, capable of resting on the road subsurface.

A symmetrical mode of operation of the retaining means results from arranging the projecting ends of the retaining means oriented towards or away from each other in a selected manner. This allows for the receiving element to be formed to force the projecting ends to seat in engagement with the receiving member. Preferably, the receiving member comprises a channel and/or rail, having recesses or protrusions against which the projecting ends, preferably claws, conforming to the recesses or protrusions, can engage. The elastic nature of the strip itself acts to resiliently bias the retaining bias in hooked position. In addition, the channel member may be provided with a central wedge or strip along its bottom which acts to force and hold the claws in proper engagement. When a channel-shaped receiving element is used, an elastomeric material may be formed in situ completely therein which both acts to resiliently bias the projecting portions of the retaining members as well as set the retaining members within the material when subsequently hardened. The channel is, in addition, completely sealed against moisture and water.

According to the present invention, the longitudinal expansion of the strip as well as the mutual shifting of the retaining members along the longitudinal direction can be precluded by threading and connecting each of the retaining members by a cable, which is vulcanized in situ within the longitudinal edge of the strip.

Another particularly advantageous embodiment of the present invention consists in forming the elastomeric strip as a pleated structure with the fold direction running perpendicular to the longitudinal edges. The pleated structure can be formed with helical inserts conforming to the cross-sectional design of the pleated structure and with connecting cables running longitudinally through the strip threaded through the upper and the lower connections of each of the pleat members of the structure.

Full details of the present invention are set forth in the following description and are shown in the accompanying drawings.

DESCRIPTION OF THE INVENTION

Figure 1:
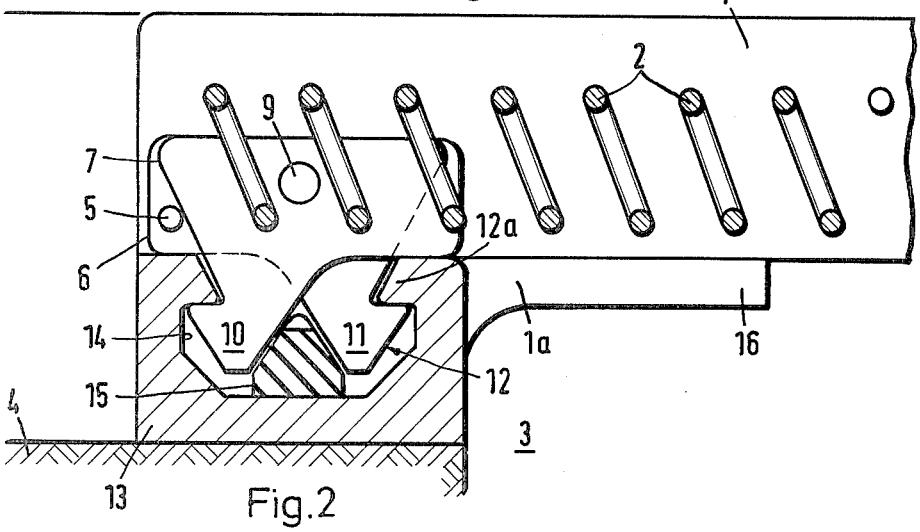
FIG. 1 is a transverse section through an expansion joint assembly showing the present invention with respect to one longitudinal edge, mounted on one section of the roadway.
Figure 2:
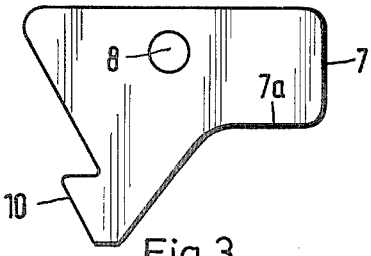
FIGS. 2 and 3 are side views of retaining elements employed in the assembly of FIG. 1.
Figure 3:
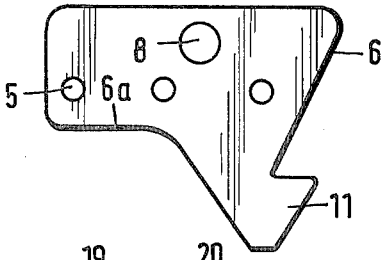

In FIG. 1, an expansion joint assembly embodying the present invention is partially illustrated showing in cross-section one longitudinal edge. The opposite edge is an identical but mirror-image structure. The assembly comprises an elongated plate-like strip 1 of elastomeric material, extending perpendicular to the plane of the paper. Embedded in the strip 1 are one or more resilient reinforcements, here shown in the form of a helical coil 2 which extends with its central axis transversely across the strip 1 bridging the gap formed between abutting sections of the roadbed of which only one subbase 4 is shown. Each end of the spring 2 is threaded through a series of holes 5 formed in a pair of plate-like retaining members 6 and 7 which are themselves partially embedded within the strip 1. The retaining members 6 and 7 are illustrated in FIGS. 2 and 3 and comprise identical plate members having a generally rectangular head or upper portion from which depends a projecting portion, which in this embodiment is formed with claws 10 and 11, respectively. The claws 10 and 11 are triangular in shape and have straight edges. In the illustrated form, the retaining members 6 and 7 are identical, although they need not be. In any event, it is preferable that the lower edges 6*a* and 7*a* are straight, so that the head may be embedded thereto, whereby they are coincident with the lower edge 1*a* of the strip and form at least in part the load bearing surface of strip 1.

The retaining members 6 and 7 are arranged in pairs or sets, in which the members 6 face in one direction and the members 7 face in the opposite direction in alternate juxtaposed relationships to each other.

The retaining members 6 and 7 are spaced laminarly closely along the longitudinal edge of the strip 1 in parallel vertical laminar planes. The arrangement may be in any combination or pairs or sets, but preferably with an equal member facing in each direction transverse to the longitudinal axis of the strip 1. Each of the retaining members 6 and 7 have a central hole 8 through which a cable 9 extending through the length of the strip 1 passes and is itself permanently bonded in situ within the strip 1. The cable 9 strings together the several pair or sets of retaining members 6 and 7. Preferably the cable is secured as by welding or otherwise to each of the individual, pairs, or sets (as desired) of the retaining members, so that their displacement in the longitudinal direction relative to each other is prevented.

The strip 1 is adapted to rest upon an elongated receiving element 13 or bearing block which is formed to receive the depending projection. The receiving element 13 is provided with an elongated channel 12, open at the top, running along its entire length, and is secured by bolts or similar means permanently to the subbase 4 of the road. The opening in the channel 12 is provided with inwardly directed lips 12*a* which are bevelled to flare at an angle outwardly. The lips 12*a*, thus, form inwardly retaining hook means adapted to engage the claws 10 and 11. Mounted along the bottom of the channel 12 is an elongated elastomeric strip 15, which also has angled edges.

When installing the expansion joint assembly, the projecting portions of the retaining means are pushed in through the top of the receiving elements. Due to the deformability of the strips the claws 10 and 11 ride along the inner edges of the lips 12*a* and are pushed inwardly toward each other while passing through the narrowest point between the lips. As the claws 10 and 11 move into the enlarged section of the channel, the claws are then caused to spring outwardly from each other due to the inherent resiliency of the strip 1. As a result, the top edges of the claws 10 and 11 spring outwardly to grasp beneath the lips in a firm clamping action. The strip 15 at the bottom of the groove acts to force the claws 10 and 11 outwardly and thereafter maintain the claws in a hooked position throughout use. The receiving element 13 is provided with a plurality of finger-like extensions 16, extending into the gap 3 between the adjacent sections of the roadbed subbase. After the strip 1 is installed, the usual paving such as macadam, or tarmac surface may be placed over the subbase 4 to the upper level of the strip 1. Removability of strips is equally simple, requiring only deformation of the strip sufficiently to move the claw members out of engagement with the receiving element. Removal of the pavement is not necessary.

It will be seen that embedding the plate-like retaining members at least in part within the edge of the strip 1 provides them with a resilient spring-like ability to move toward and away from each other so that they can be easily and detachably snapped within the elongated groove of the receiving element 13. Because of the conforming shape of the lower edge of the rectangular head portion of the plate-like retaining member, the upper surface of the retaining element, serving here as a bearing block, and the conforming interior contour of the channel corresponding to the claw-like members, ensure that the claws cooperatively engage and securely and firmly seat the strip in and on the receiving element.

The retaining members not only form the means for connecting the strip 1 to the subbase 4, but also serve to stiffen and reinforce the edge of the elastomeric strip 1, so that a continual strong and flush connection is made between it and the subbase, notwithstanding the load placed thereon by the vehicular traffic. Because the retaining members are permanently bound within the material of the elastomeric strip, an automatic restorative force is generated by their relative movement. Preferably, the retaining members are made of hard material such as steel or hardened synthetic material which has a degree of ductility and resiliency. The elastomeric material for the strip is preferably of a natural and/or synthetic rubber.

Because the resilient reinforcements, i.e. coils 2, run over the section of the strip 1 bridging the gap 3, and are anchored by at least three (3) turns to each of the retaining members, a strong and firm connection with the strip as well as with the subbase is obtained, allowing the entire strip to have a strong restorative force upon contraction and expansion. The use of springs secured to the embedded retaining members, maintains the entire assembly under a resilient compression so that a strong, unitary, and integral, but elastic assembly is formed which resists buckling.

By placing the retaining members in pairs and/or sets with their claws alternating in opposite directions from each other, a uniform distribution of the forces across the length of the strip and the length of the gap is made. The force by which the retaining members clamp onto the receiving element so that a secure arrangement is made, generated by the fact that the retaining claws are turnable or moveable parallel to each other but in opposite directions. The basic elastomeric strip is stressed in both thrust and in torsion because the laminar and parallel arrangement of the retaining means, close spaced, prevents any twist relative to the longitudinal axis. This longitudinal stress is enhanced when the connecting cable is employed. Stressing under tension, and/or in compression in the transverse direction, as by the rise of the springs can also be accomplished in other ways as by the use of the cables.

In the embodiment of FIG. 1, a strong clamp action is obtained through the symmetrical operation resulting from the fact that the claws are oriented in two directions which are opposite to each other. The use of the central wedging strip 15 assures the locking of these oppositely directed claws in their effective position. Instead of or concomitant with the use of the retaining strip 15, an uncured elastomeric material may be poured into the groove. After the claws 10 and 11 have been hooked into place and upon hardening of this material, the claws 10 and 11 will be permanently held in place, and a perfect seal made within the channel preventing the entry of any moisture or dirt therein.

The use of the connection cable 9 has the advantage that the longitudinal expansion of the strip 1 as well as the relative shifting of the retaining members can be avoided since the cable 9 effectively seats and holds the members of their initial positions.

Figure 4:
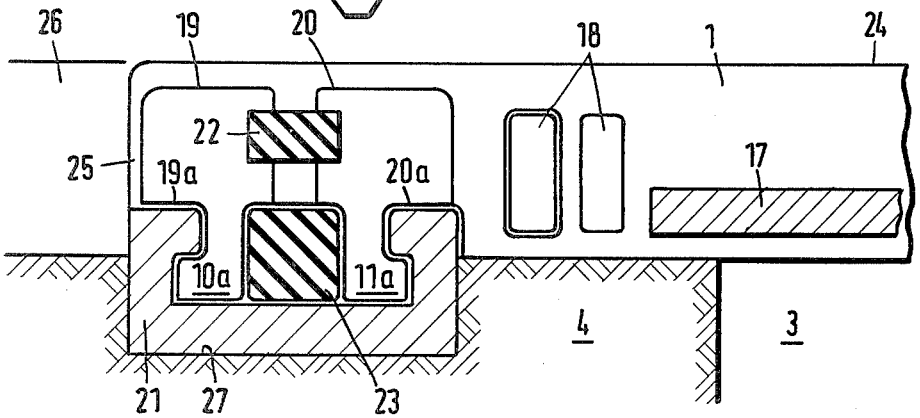
FIG. 4 is a view similar to that of FIG. 1, showing another form of the present invention.

In FIG. 4, an embodiment is shown wherein an elastomeric strip 1 is formed having one or more plate-like inserts 17 of a length sufficient to bridge the gap 3 between adjacent sections of the roadbed. In addition, several cavities 18 extending length-wise along the edge of the strip are provided. The inserts 17 reinforce the strip while the cavities 18 provide the resiliency necessary to permit transverse expansion and contraction. Retaining members 19 and 20 are generally laminar plates having an upper rectangular head portion embedded along the longitudinal edges of the strip 1 in the manner previously described. Depending from the head portion is a projecting portion ending in claw-like sections 10*a* and 11*a*, respectively, which are adapted to engage in a retaining element, provided with an inverted T-shaped channel 21*a*. Differing from the embodiment of FIG. 1, the claws 10*a* and 11*a* and the walls of the channel 21*a* are not angular but vertical and horizontal. The members 19 and 20 are mounted in coplanar pairs with the claws 10*a* and 11*a* facing in opposite directions. A plurality of these pairs are spaced along the longitudinal edge of strip 1. Mounted between the paired retaining members 19 and 20 are two elastomeric elements 22 and 23 which act to resiliently bias the retaining members apart while holding them in relative fixed position. The element 22 extends the length of the strip and fits within a slot formed within the abutting edges of the head portion of the paired members 19 and 20 while the element 23 is mounted between the depending projections along the lower edge of the groove. The arrangement of paired retaining members 19 and 20 are preferably repeated at short distances from each other over the entire longitudinal edge of the strip 1.

The upper rectangular portions of each of the members 19 and 20 have straight lower edges 19*a* and 20*a* and are so embedded within the strip 1 that while the sides and upper edges are fully covered by elastomeric material 25 these lower edges are coincident with the lower edge of the strip 1 so that they form a bearing surface with the strip against the bearing surface formed by the edges of the receiving element 21.

As shown in FIG. 4, receiving means 21 is set within a recess 27, formed in the concrete subbase for the roadway. In this manner, lateral movement of the receiving element and its permanent securement to the base 4, can be made. The remaining portion between the subbase 4 and the upper edge 24 of the strip 1 can be filled in with the usual pavement 26.

Figure 5:
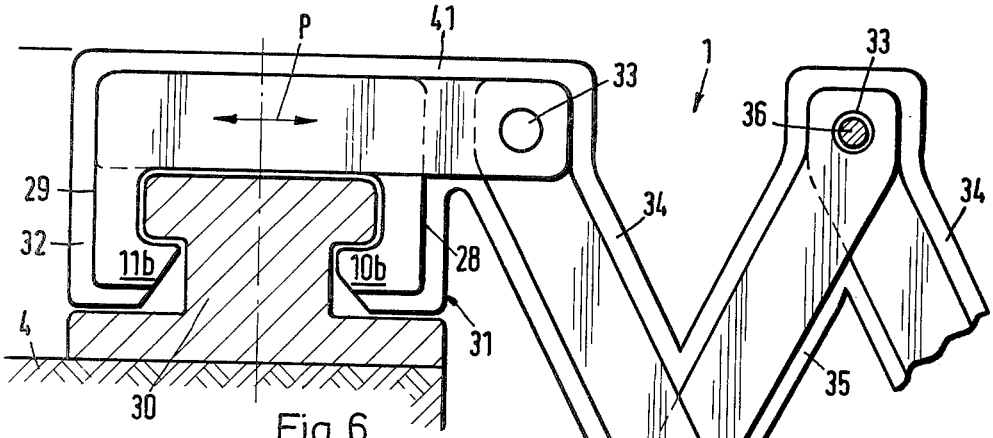
FIG. 5 is a view similar to that of FIG. 1, showing, as a pleated strip, the present invention.
Figure 6:
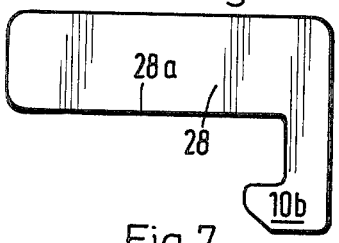
FIG. 6 is a side view of a retaining element employed in the assembly of FIG. 5.
Figure 7:
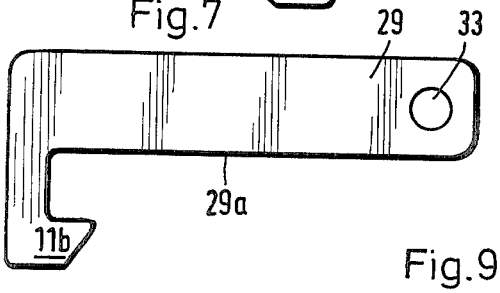
FIG. 7 is a side view of another retaining element employed in the assembly of FIG. 5.

In FIG. 5 still another embodiment is shown, wherein the retaining members 28 and 29 are more in the form of a flat, plate-like horizontally elongated rectangular members having their depending portions formed at one end. The claws 10*b* and 11*b* are, respectively, formed at the bottom of these projections. The member 28 is somewhat shorter than that of the member 29 for reasons that will be apparent shortly. The retaining members are adapted to rest on the upper surface of a receiving element, which has a T-shape form similar to that of a railway rail. To effect this, the members 28 and 29 are embedded in the edge 41 of the strip 1 so that the central portions 28*a* and 29*a* are coincident with the bottom surface of the strip 1. The strip is molded, however, about the outer surfaces of the members 28 and 29 as indicated by the numerals 31 and 32. The members 28 and 29 are arranged in pairs or in sets other than pairs as described earlier so that there is an arrangement of alternating members. The short edge of member 28 and the long edge formed by the projection of member 29 lie in a vertical plane along the outer longitudinal edge of the strip, so that the claws 10*b* face toward the claws 11*b* in the inward direction. The inwardly extending end of the longer retaining member 29 is provided with a hole 33 and extends beyond the long edge of the smaller retaining member 28.

The member 29 is connected to an insert 34 which reinforces the strip 1. This insert 34 and additional inserts 35 of similar form are arranged in a pleated articulated manner to form a lattice-like design between the longitudinal edges of the strip 1. The inserts 34 and 35 have holes 33 at their ends through which cables 36, of a low modulus of elasticity are threaded and permanently bonded in situ within the strip 1. The cables 36 prevent the strip from stretching in the lengthwise direction while permitting expansion and contraction similar to an accordian, in the transverse direction. At the same time, the reinforcing inserts 34 and 35 are held by the cables 36 which prevent them from shifting longitudinally with respect to each other.

Figure 8:
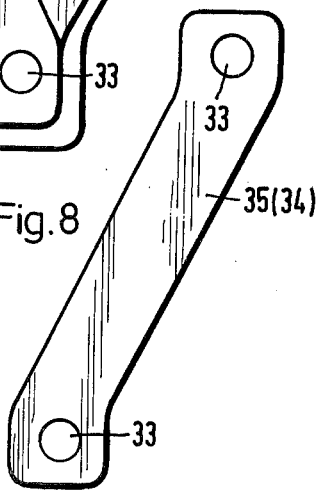
FIG. 8 is a side view of the structure of the leg used in forming the pleated structure of FIG. 5.
Figure 9:
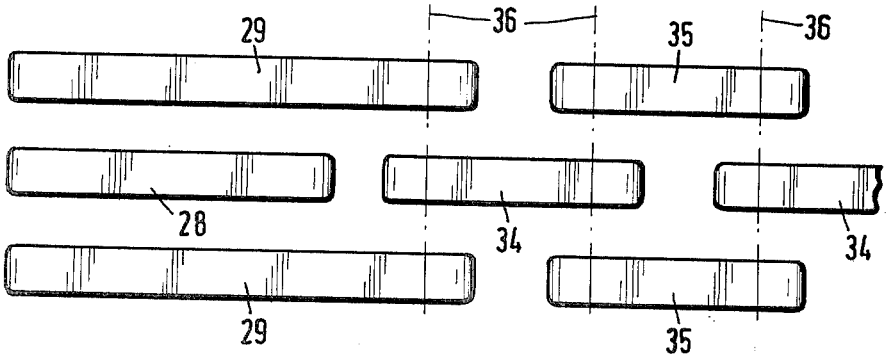
FIG. 9 is a schematic plan view of the assembly according to FIG. 5.

Like the retaining members 28 and 29, the inserts 34 and 35 are of laminar design formed of steel or hard synthetic material and covered completely by the elastomeric material. The inserts 34 and 35 are mirror or reverse images of each other as seen in FIG. 8, and as seen in FIG. 9 and are distributed alternately one after the other in close proximity to each other the entire length of the strip 1 and embedded within the elastomeric material which itself forms continuous strips flexible in the transverse direction about the cables 36. A particular advantage of this structure lies in the fact that the fold direction runs perpendicular to the longitudinal edges and that the inserts 34 and 35 can have particularly selected designs, which permit the expansion and the contraction in the transverse direction while the strip is clearly limited in distention longitudinally, by the parallel longer connecting cable 36.

The clamping action of the claws 10*b* and 11*b* are inward toward each other, not outward as is the case in FIGS. 1 and 4. In addition, the plate-like retaining members 28 and 29 move generally parallel to each other under deformation of the elastomer rather than pivotally since there is no central cable. During installation over rail-shaped receiving element 30, the claw members 10*b* and 11*b* are first moved relatively away from each other in the direction of the double arrow P so that their mutual spacing first increases under the corresponding expansion of the elastomeric mass of the basic strip 1. Afterward, they snap over the T-shaped arms of the receiving element 10 and upon relaxation of the material, the initial relaxed condition of the strip 1 is obtained and the hook-like members 10*b* and 11*b* are permanently held in place on the receiving element 30, much in the manner of ice tongs.

What is claimed:

1. An expansion joint assembly for covering gaps between adjacent sections of vehicular road beds, bridges and the like comprising an elongated elastomeric strip having a plurality of retaining members embedded at least in part in and bonded securely to the elastomeric strip along the longitudinal edges thereof, said retaining members having engaging means extending from said strip and being arranged so that the engaging means of at least one of said retaining members face in one direction and the engaging means of at least one of the other retaining member faces in another direction so as to cooperatively move under deformation of said strip to detachably engage with a receiving element located in said road bed.

2. The assembly according to claim 1 wherein said retaining elements are plates and are arranged along the longitudinal edges in spaced relationship in parallel laminar planes running transversely to the longitudinal edges.

3. The assembly according to claim 2 wherein the retaining members are arranged in selected sets, the retaining members in each set being alternatively arranged so that their engaging means are juxtaposed to each other.

4. The assembly according to claim 2 wherein said retaining members are arranged in pairs in a common plane with their engaging means juxtaposed to each other.

5. The assembly according to claims 1, 2, 3 or 4 wherein said engaging means comprises claws-like hooks.

6. The assembly according to claims 1, 2 or 3 wherein said retaining members are movable pivotally with respect to each other on deformation of said strip.

7. The assembly according to claim 6 including a restraining cable extending longitudinally through each of said retaining means.

8. The assembly according to claim 1, 2 or 4 wherein said retaining members are movable in parallel planes and relative to each other.

9. The assembly according to claim 8 including a restraining cable extending longitudinally through selected ones of said retaining members.

10. The assembly according to claim 1 including at least one reinforcement embedded within said strip extending transversely thereof.

11. The assembly according to claim 10 wherein said reinforcements comprise a helical coil attached to each end to said retaining members.

12. The assembly according to claim 11 wherein said reinforcements comprise elongated bars.

13. The assembly according to claim 12 wherein the bars are hingedly connected to said retaining members.

14. The assembly according to claim 1 wherein said strip comprises a pleated structure having a plurality of members hingedly connected to each other extend transversely across said strip, the fold lines of said structure extending longitudinally along said strip.

15. The assembly according to claim 14, including reinforcing members embedded in said pleats, said reinforcing members being connected by restraining cables extending longitudinal ghrough said strip.

16. The assembly according to claim 1 in combination with a receiving element comprising an elongated channel member adapted to receive said engaging means and defining surfaces conforming to said engaging means to cooperably lock in engagement therewith.

17. The assembly according to claim 1 in combination with a receiving element comprising an elongated member comprising a rail on which said engaging means is received and defining surfaces conforming to said engaging means to cooperably lock in engagement therewith.

18. The combination of claim 16 or 17 wherein said retaining means have an edge forming a bearing surface adapted to rest on said receiving element.

19. The combination according to claim 16 including resilient means within said channel to abut said engaging means and bias the same in locking engagement.

20. The combination according to claim 19 wherein said engaging means comprises a strip of elastomeric material extending along the bottom of said channel.

21. The combination according to claim 16 wherein said engaging means comprises a block of elastomeric material formed in situ with said channel.

* * * * *